US009783343B2

(12) United States Patent
Seguin et al.

(10) Patent No.: US 9,783,343 B2
(45) Date of Patent: Oct. 10, 2017

(54) CONTAINER, PARTICULARLY A TUB FOR COSMETIC PRODUCT AND METHOD FOR MANUFACTURING SAME

(75) Inventors: Franck Seguin, Paris (FR); Thierry Balestrini, Leudeville (FR); Nicolas Rondeau, Villeneuve la Garenne (FR); Victor Ramos, Rambouillet (FR); Remy Laine, Landevant (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 14/003,258

(22) PCT Filed: Mar. 8, 2012

(86) PCT No.: PCT/EP2012/053957

§ 371 (c)(1),
(2), (4) Date: Nov. 21, 2013

(87) PCT Pub. No.: WO2012/120066

PCT Pub. Date: Sep. 13, 2012

(65) Prior Publication Data

US 2014/0061198 A1 Mar. 6, 2014

(30) Foreign Application Priority Data

Mar. 8, 2011 (FR) ..... 11 00696

(51) Int. Cl.
*B65D 53/04* (2006.01)
*B65D 41/00* (2006.01)
(Continued)

(52) U.S. Cl.
CPC ..... *B65D 41/005* (2013.01); *A45D 33/006* (2013.01); *A45D 33/28* (2013.01);
(Continued)

(58) Field of Classification Search
CPC ..... F16J 15/48; B65D 53/06; B65D 53/02; B65D 41/005; B65D 53/04; A45D 33/00;
(Continued)

(56) References Cited

U.S. PATENT DOCUMENTS 2,833,398 A * 5/1958 Marshall ..... B65D 51/26 206/459.1
2,880,900 A * 4/1959 Foye ..... B65D 51/26 215/231

(Continued)

FOREIGN PATENT DOCUMENTS

| | | |
|---|---|---|
| DE | 29804388 | 7/1999 |
| EP | 0858954 | 8/1998 |
| FR | 1537953 | 8/1968 |

OTHER PUBLICATIONS

Definition of "pad" as provided by Dictionary.com, 2015. http://dictionary.reference.com/browse/pad?s=t.*

*Primary Examiner* — James N Smalley
(74) *Attorney, Agent, or Firm* — Steven M. Greenberg, Esq.; CRGO Law

(57) ABSTRACT

The invention relates to a container (1), such as a tub (5) for a cosmetic product, including: a base (10); a cover (20) which is arranged so as to be closed on the base (10); and a deformable pad (30) arranged between the base (10) and the cover (20), said pad (30) including a shell (33) and a seal (40) forming a sealed enclosure, as well as a fluid (36) contained in the shell, the pad (30) being arranged so as to apply a load onto the base (10) via the seal (40) when the cover (20) is closed on the base (10).

22 Claims, 10 Drawing Sheets

(51) Int. Cl.

| | |
|---|---|
| ***A45D 33/00*** | (2006.01) |
| ***A45D 33/28*** | (2006.01) |
| ***A45D 34/00*** | (2006.01) |
| ***A45D 34/06*** | (2006.01) |
| ***A45D 40/00*** | (2006.01) |
| ***A45D 40/18*** | (2006.01) |
| ***A45D 40/22*** | (2006.01) |

(52) U.S. Cl.
CPC ..... *A45D 34/00* (2013.01); *A45D 34/06* (2013.01); *A45D 40/0068* (2013.01); *A45D 40/18* (2013.01); *A45D 40/22* (2013.01); *B65D 53/04* (2013.01); *A45D 2034/002* (2013.01); *A45D 2040/0006* (2013.01); *A45D 2200/051* (2013.01); *Y10T 29/49826* (2015.01)

(58) Field of Classification Search
CPC .... A45D 33/28; A45D 40/0068; A45D 40/22; A45D 34/06; A45D 40/18; A45D 33/006; A45D 34/00; A45D 2040/0006; A45D 2034/002; A45D 2200/051; Y10T 29/49826
USPC ..... 220/849, 375, 378; 277/645, 646; 206/235, 581; 132/293
See application file for complete search history.

(56) References Cited

U.S. PATENT DOCUMENTS

| | | | | |
|---|---|---|---|---|
| 3,454,191 | A * | 7/1969 | Mercier | F15B 1/106 220/256.1 |
| 4,215,786 | A * | 8/1980 | Vertes | B65D 51/26 206/591 |
| 5,096,078 | A * | 3/1992 | McQueeny | B65D 51/26 206/522 |
| 6,050,199 | A * | 4/2000 | Anderson | B61D 17/16 105/377.07 |
| 2001/0032850 | A1* | 10/2001 | Neuner | B65D 53/00 220/232 |
| 2005/0012281 | A1* | 1/2005 | Ludwig et al. | 277/646 |
| 2008/0190933 | A1* | 8/2008 | Bougon | B65D 81/245 220/361 |
| 2010/0096411 | A1 | 4/2010 | Deans | |

* cited by examiner

CONTAINER, PARTICULARLY A TUB FOR COSMETIC PRODUCT AND METHOD FOR MANUFACTURING SAME

CROSS-REFERENCE TO RELATED APPLICATIONS

This application is a §371 national phase entry of International Application No. PCT/EP2012/053957, filed Mar. 8, 2012, which claims priority to French Patent Application No. 1100696, filed Mar. 8, 2011.

The invention relates generally to containers comprising a base surmounted by a lid and adapted to contain products, particularly cosmetic products such as creams, powders, etc., and their sealing systems.

The invention will be described below in a non-restrictive manner in relation to cosmetic applications. It will nevertheless be understood that it is also applicable to any container provided with a lid, such as pots of paint, tins of tea, etc., and requiring a good seal.

Conventional tubs for cosmetic products generally have threaded closure systems, enabling the tub to be closed by screwing a lid onto the base thereof. The threading ensures that the pressure of the lid on the base is homogeneous, thus ensuring its hold and its seal.

In the field of cosmetic products, tubs must be capable of ensuring a minimum leak resistance despite variations in pressure of some hundred millibars, in order to avoid any risk of opening or leakage of product in any circumstances, such as, for instance, in the user's bathroom, or during transport in the hold of an aircraft in flight. A test regularly performed to determine the leak resistance of a tub for a cosmetic product consists, for example, of filling the tub with a liquid (water or glycerine, usually coloured) and placing it upside-down (in other words, with the lid downwards and the base upwards) or on its side on absorbent white paper in a vacuum bell jar. The pressure is then lowered in steps of 0.1 bar, or 75 mmHg, every minute, until a pressure of approximately 200 to 250 mbar is reached. The objective is to verify that at such a pressure, no liquid escapes during a period of at least ten seconds.

It has therefore been proposed that the leak-resistance of the closure of tubs be improved via a seal disposed between the lid and the tub.

However, the leak-resistance of tubs of cosmetic products is more difficult to achieve where the lid is articulated on the base of the tub and held in a closed position via a latch-type closure member. This system of tub closure is increasingly sought-after on the market by users, who consider it easier and more pleasant to use than conventional screw systems. However, it is less leak-resistant in comparison with screw systems, particularly because of the reduced stresses applied by the lid on the base of the tub.

To remedy this disadvantage, document US 2010/0096411, for example, proposed the addition of a ring seal between the lid and the tub, in such a way as to increase the leak resistance between the base and the lid. However, in order to make the leak resistance of this system compliant with the vacuum test described above, the dimensions of the seal and the materials of which it is made and also the closure system are chosen so that they compress the seal strongly in the closed position, which increases the effort required for a user to open and/or close the tub.

It is therefore necessary to make the right compromise between the leak resistance of the tub and its ease of use.

One objective of the invention is therefore to propose a container, particularly a tub for cream or a powder compact, provided with a lid, and whose closure system is leak-resistant in different circumstances, particularly in accordance with the leak resistance tests performed in a vacuum bell jar, without, however, being more difficult for users to open or close.

For this, the invention proposes a container such as a tub for a cosmetic product, comprising:

a base;

a lid, arranged in order to be closed on the base; and a deformable pad disposed between the base and the lid; said pad comprising a shell and a seal forming a sealed enclosure and also a fluid contained in the shell, the pad being arranged so as to apply a load to the base via the seal when the lid is closed on the base.

Some preferred but non-restrictive aspects of the container are as follows:

- the fluid is at atmospheric pressure;
- the fluid is air;
- the seal is made of a deformable resilient material, in particular a thermoplastic elastomer such as vulcanised TPB or TPU urethane (with a Shore hardness below 85 Shore A); styrene-ethylene-butadiene-styrene (SEBS), silicone TPU, TPV with a Shore hardness of 85 A
- in which the pad is fixed so that it is integral with the lid;
- the shell comprises an upper part and a lower part joined to the upper part;
- the upper part and the lower part are of a polypropylene or styrene-ethylene-butadiene-styrene (SEBS) type plastics material;
- the seal is overmoulded onto the upper or lower part of the shell or is dual-injected therewith;
- the upper part and the lower part comprise a central hub and a complementary shaft adapted to cooperate with the central hub in order to join the lower part to the upper part;
- it further comprises a swivel joint between the lid and the upper part of the pad or between the upper part of the pad and the lower part of the pad;
- the base comprises a mouth with an internal wall, and the seal is disposed at the periphery of the shell and applies the load to the internal face of the mouth;
- the internal wall of the mouth is shaped as a shoulder;
- the base comprises a mouth with an upper edge, and the seal is disposed on a lower face of the shell and applies the load to the upper edge of the mouth;
- the pad comprises a lower part consisting of a plate and a border running along the periphery of the plate, and separated therefrom by a traversing passage intended to accommodate the seal;
- the seal is shaped as an omega channel, whose arms are fixed to the border and to the plate respectively, while the base extends towards the upper edge of the mouth forming a shoulder;
- the seal also comprises a resilient lip extending radially outwards from the seal, adapted so that it comes into lateral contact with the upper edge in such a way as to provide a diametral seal with the tub;
- the pad is disposed on the inside of the lid;
- the base comprises a mouth and the lid is articulated on the base so that it is movable between an open position in which the lid can pivot relative to the base and a closed position in which the lid is pressed down on the mouth of the base;
- it also comprises a closure system adapted to hold the lid in contact with the mouth of the base in the closed position; and the lid comprises an internal surface provided with threads adapted to cooperate with threads arranged on an external surface of a mouth of the base.

According to a second aspect, the invention proposes a method for manufacturing a container according to the invention, characterised in that it comprises the following steps:

providing the base and the lid of the container;

manufacturing the pad;

fixing the pad to the lid; and fixing the lid to the base.

Some preferred but non-restrictive aspects of the method are as follows:

the shell comprises an upper part, a lower part and a seal, and the method also comprises a step of assembling the upper part with the lower part and the seal in such a way as to contain the fluid in the sealed enclosure;

the upper part and the lower part are assembled by laser welding, ultrasonic welding, hot plate welding, or by glueing; and it also comprises a step of overmoulding or dual injecting the seal onto either the lower part or the upper part of the shell.

Other features, aims and advantages of the present invention will become apparent on reading the detailed description which follows, with reference to the appended drawings, given as non-restrictive examples and in which.

Figure 1:
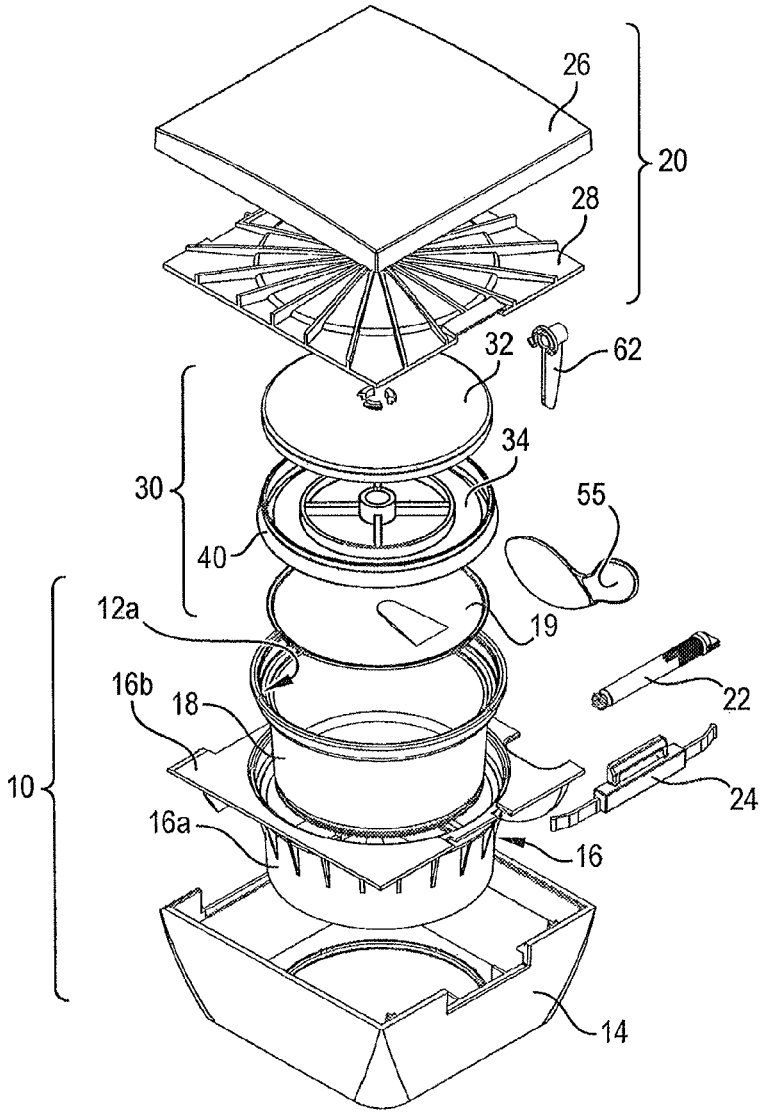
FIG. 1 is an exploded view of a first embodiment of a container according to the invention.
Figure 2:
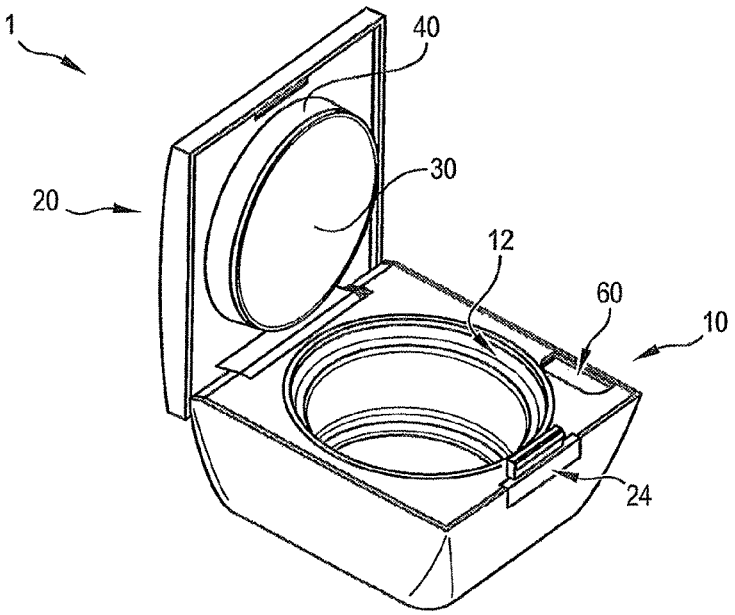
FIG. 2 is a side view of the embodiment shown in FIG. 1.
Figure 3A:
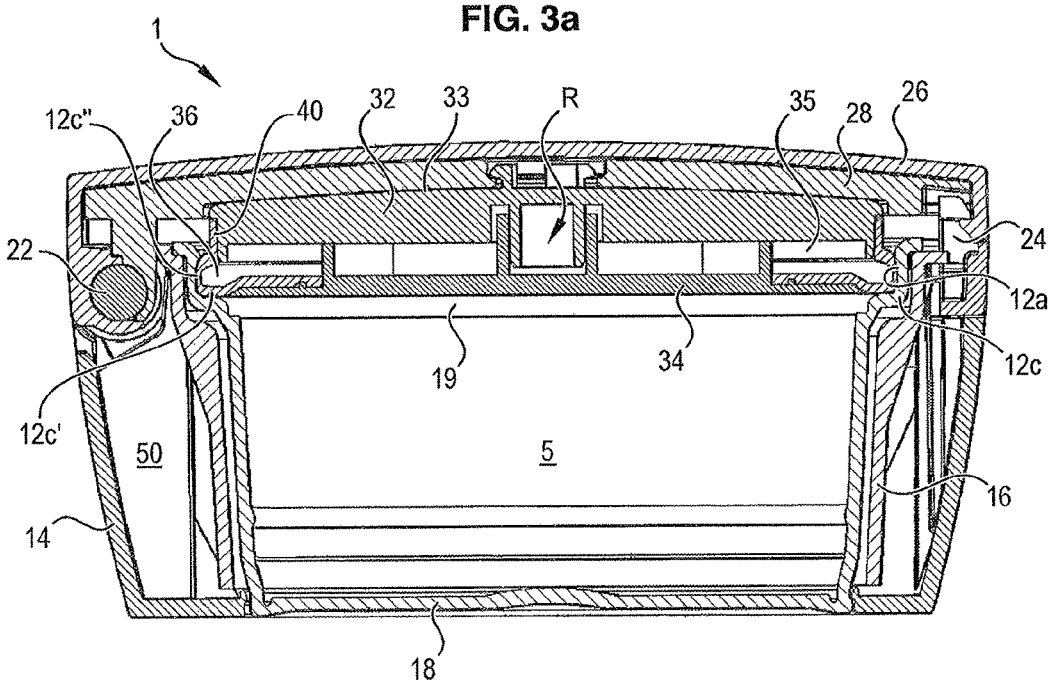
Figure 3B:
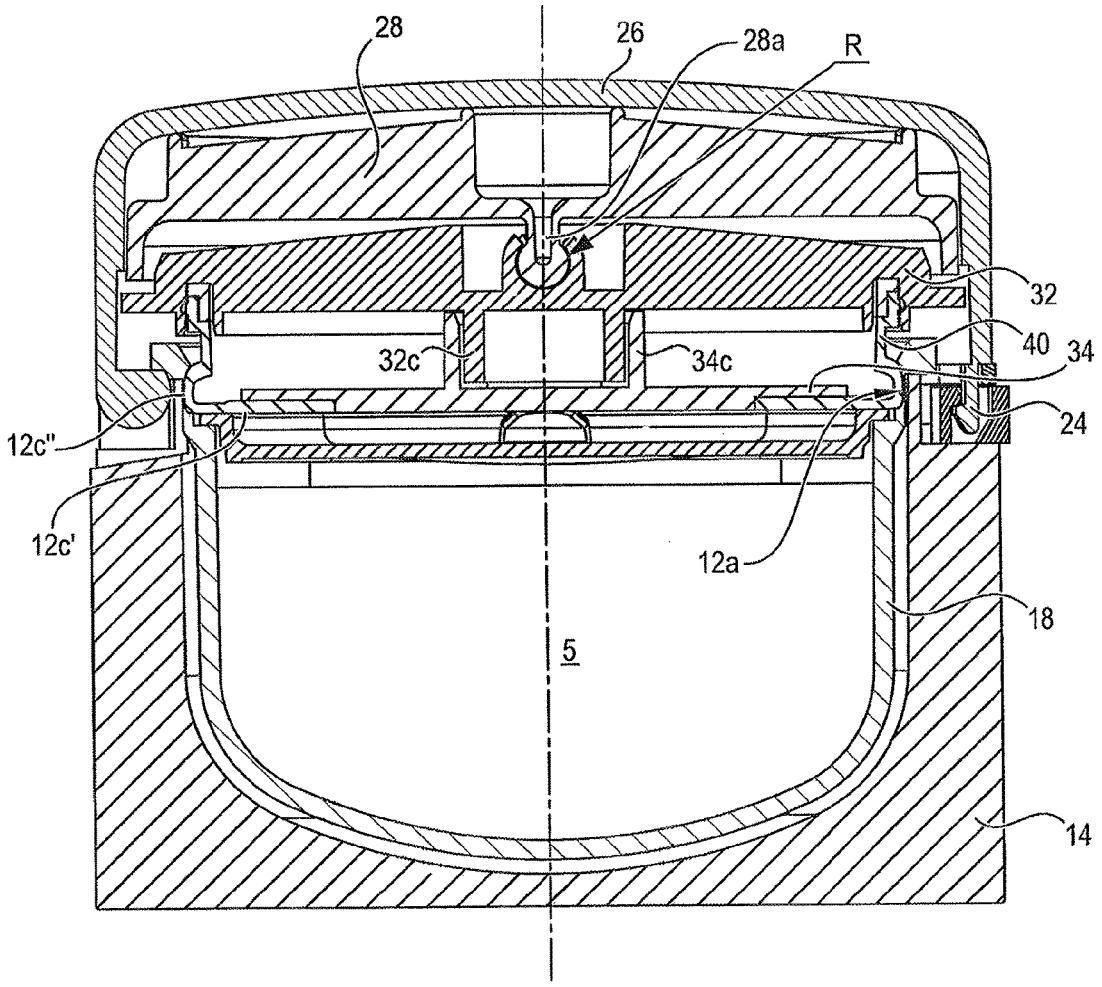

FIG. 3*a* is a view in transverse section of the embodiment shown in FIG. 1;

FIG. 3*b* shows a variant of FIG. 3*a;*

Figure 4A:
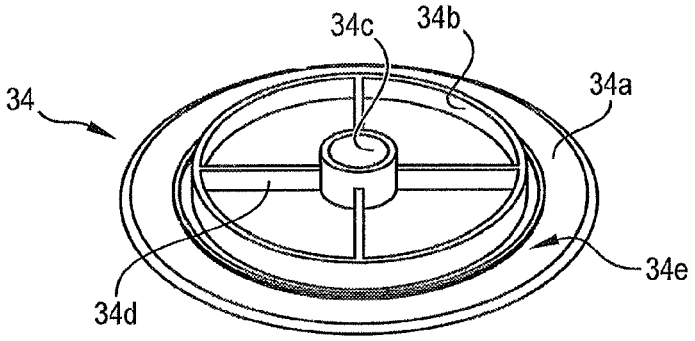
Figure 4B:
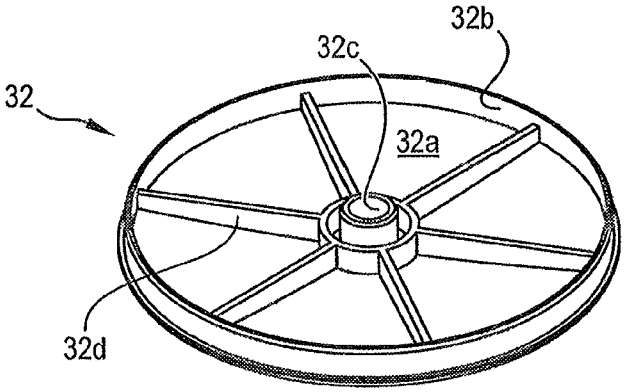
Figure 4C:
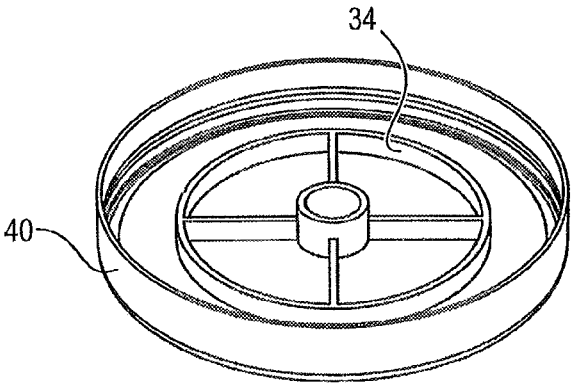
Figure 4D:
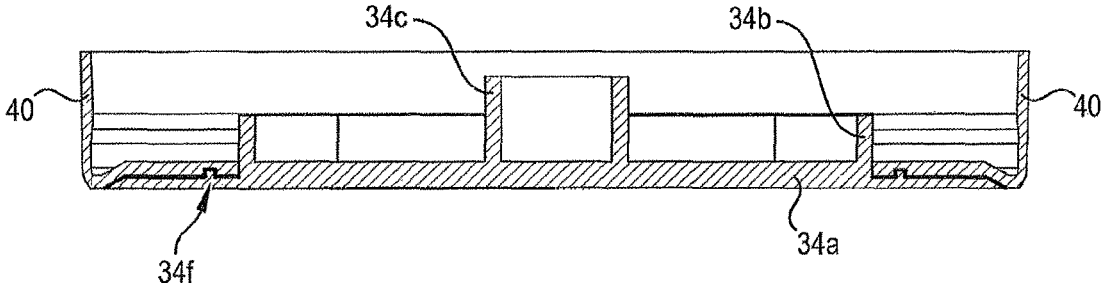

FIG. 4*a* is a view in elevation of a first constituent element of a pad capable of being used in the embodiment shown in FIG. 1;

FIG. 4*b* is a view in elevation of a second constituent element of a pad capable of being used in the embodiment shown in FIG. 1;

FIG. 4*c* is a view in elevation of the second constituent element shown in FIG. 4*b* provided with the seal;

FIG. 4*d* is a transverse section of the second element shown in FIG. 4*c;*

Figure 5:
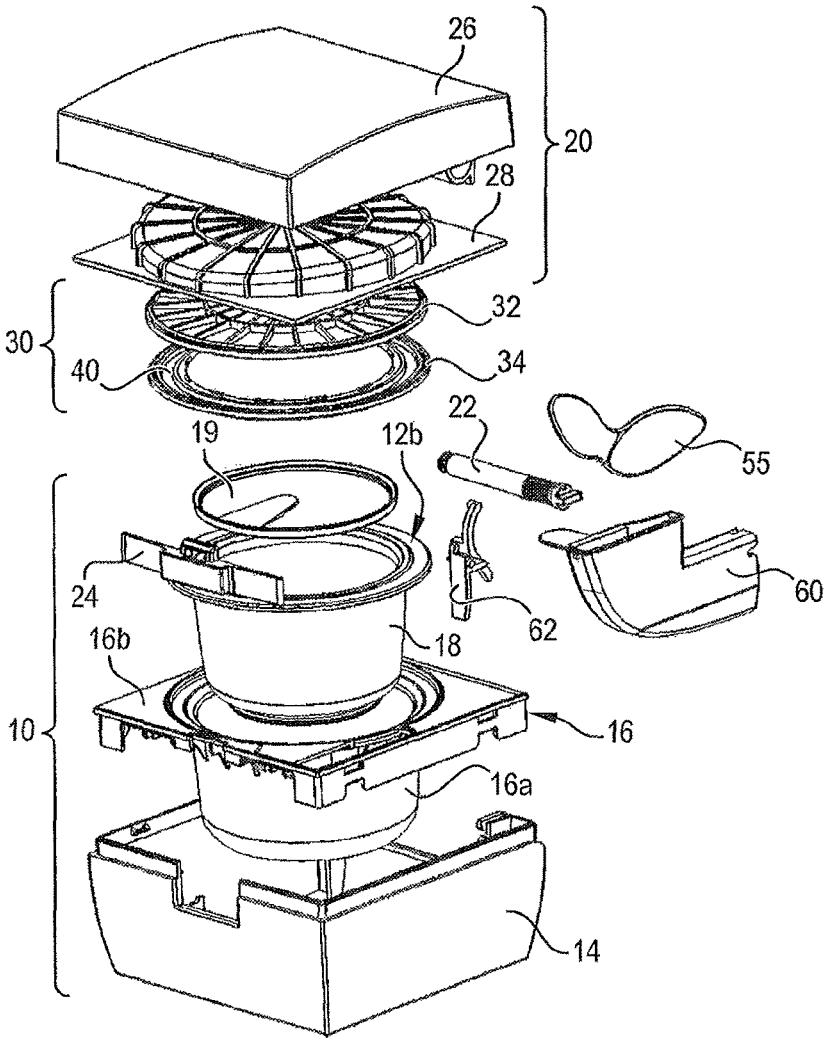
Figure 6:
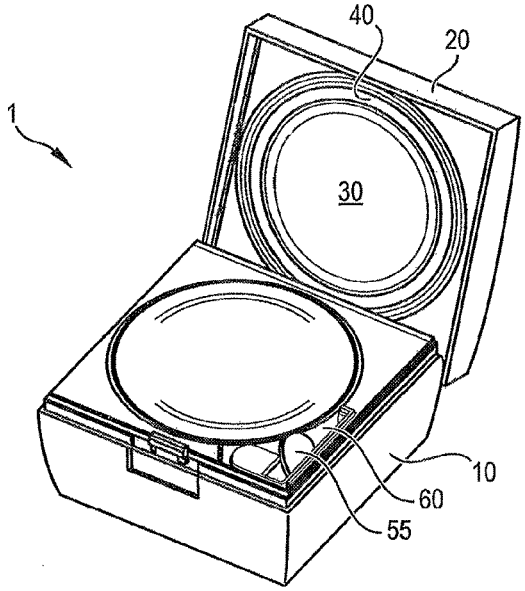
Figure 7A:
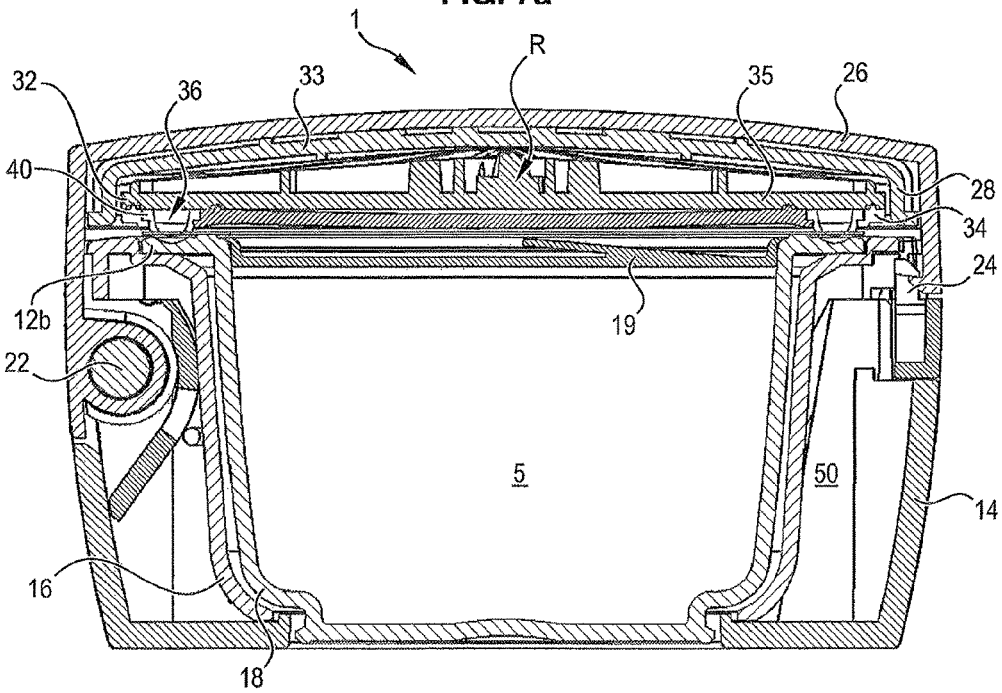
Figure 7B:
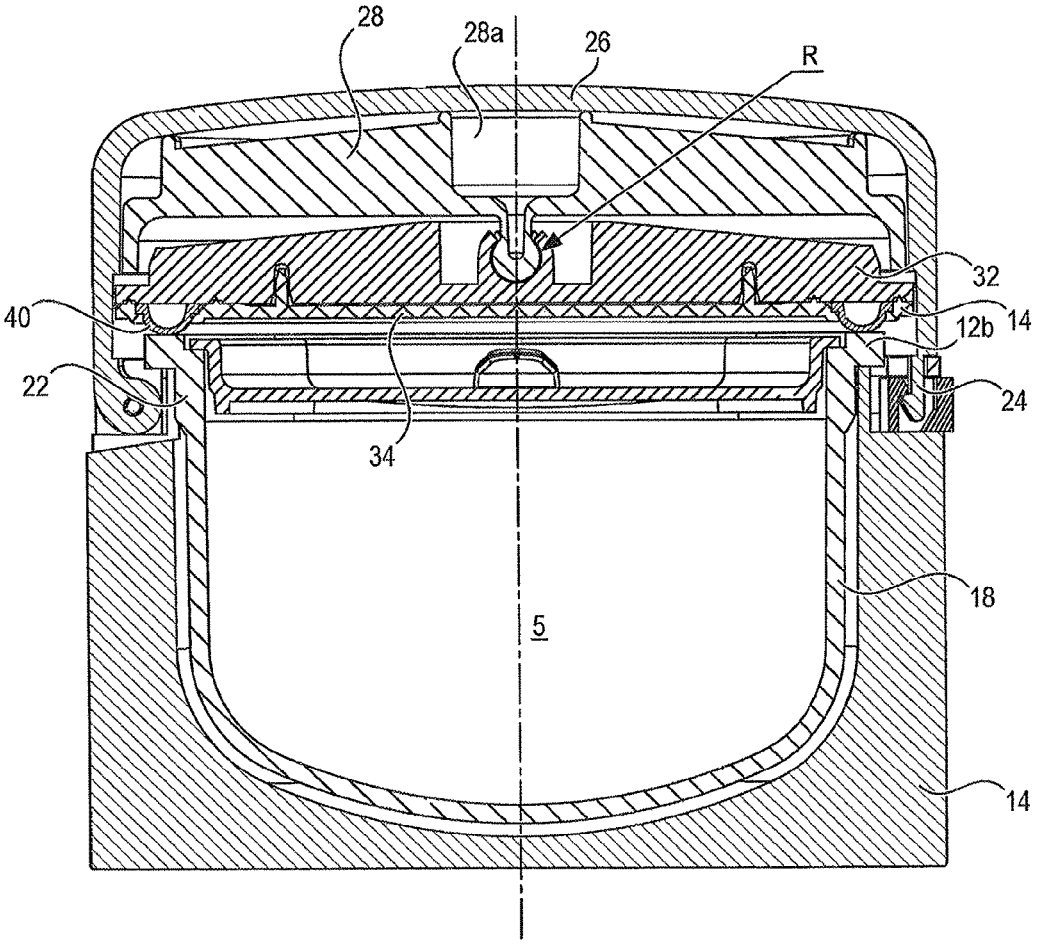

FIG. 5 is an exploded view of a second embodiment of a container according to the invention;

FIG. 6 is a side view of the embodiment shown in FIG. 5;

FIG. 7*a* is a transverse section of the embodiment shown in FIG. 5;

FIG. 7*b* is a variant of FIG. 7*a;*

Figure 8C:
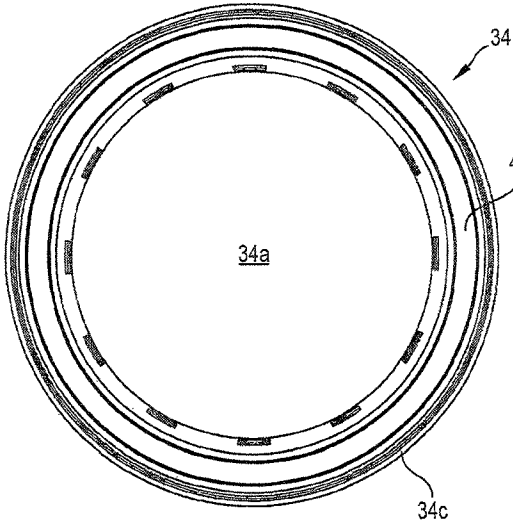
Figure 8A:
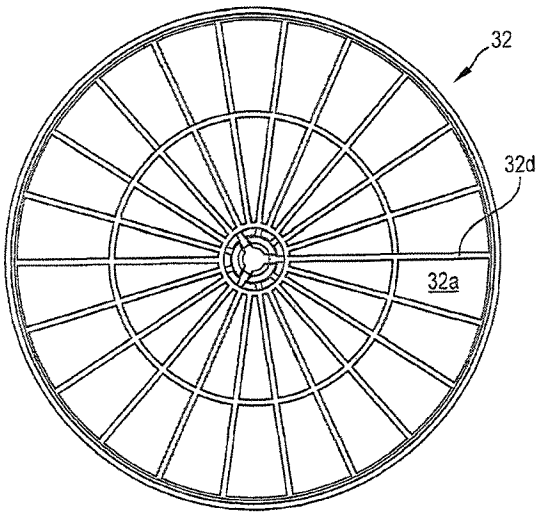
Figure 8D:
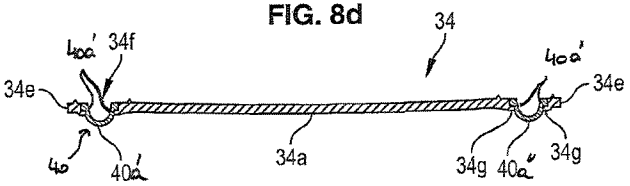
Figure 8B:
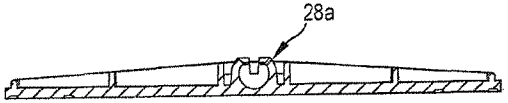
Figure 9:
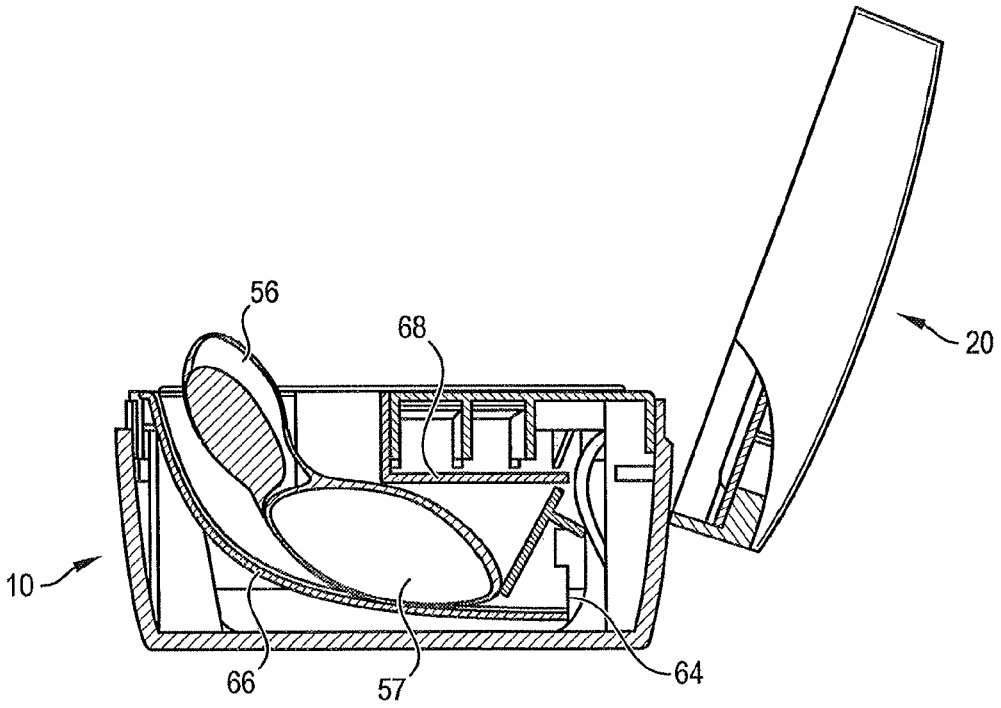

FIGS. 8*a* and 8*b* show a frontal view and a view in cross-section respectively of a first constituent element of a pad capable of being used in the embodiment shown in FIG. 5;

FIGS. 8*c* and 8*d* show a frontal view and a view in cross-section respectively of a second constituent element of a pad provided with a seal capable of being used in the embodiment shown in FIG. 5; and FIG. 9 shows a view in cross-section of a housing for an applicator adapted for use in a container according to the invention.

Figure 10:
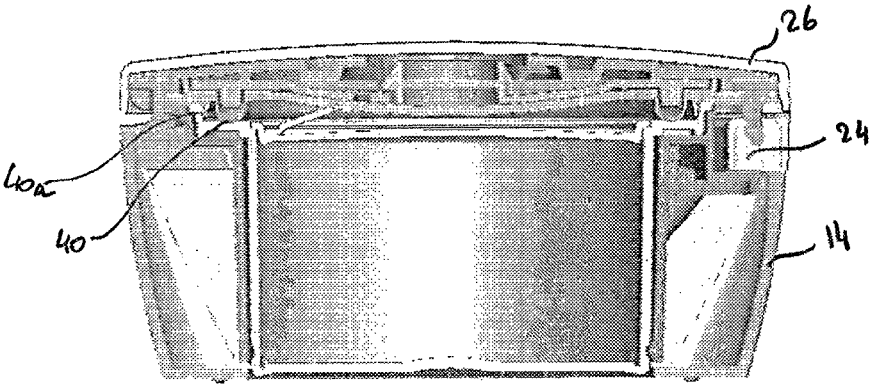
Figure 11:
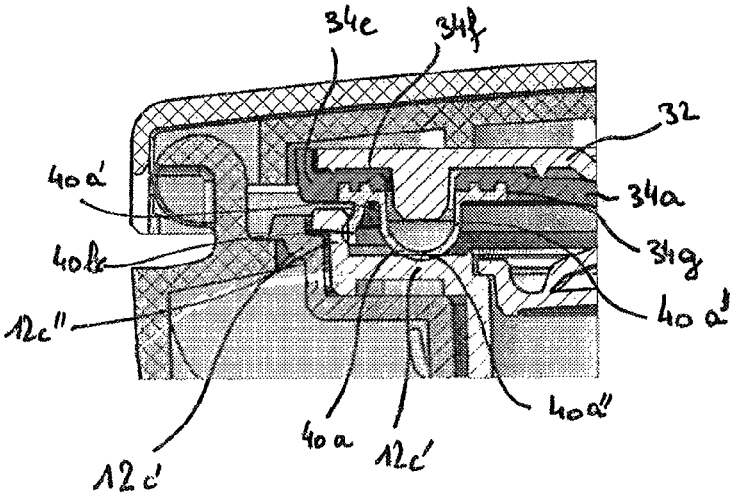

FIG. 10 is a side cut-away view of a variant of the second embodiment of the container; and, FIG. 11 is an exploded view of the container of FIG. 10 illustrating a resilient lip of the seal of the container.

A description now follows of a container 1 according to the invention with reference to the appended drawings. In the description that follows, the container 1 will be a tub for a cosmetic product 5 such as a tub for cream. However, this is not restrictive.

As shown in the drawings, a tub 1 comprises a base 10, and a lid 20 adapted to close a mouth 12 of the base 10.

The lid 20 may be articulated on the base 10 via a hinge 22. In order to hold the lid 20 pressed down on the base 10 when the tub is closed, said tub may also include a closure system 24, such as a push-button or a catch.

In a variant embodiment (not shown in the drawings), the lid 20 can be screwed onto the base 10, and therefore has threads on an internal face that are adapted to cooperate with complementary threads of an outer face of the mouth 12 of the base.

The tub 1 also comprises a pad 30, disposed between the lid 20 and the base 10. Here, the pad 30 is integral with the lid 20, so that when a user opens the tub 1 by separating the lid 20 from the base 10, the pad 30 releases the mouth 12 and allows free access to its contents 5.

This embodiment has the advantage of ensuring that the pad 30 is properly positioned relative to the mouth 12 of the base 10 and to the lid 20.

However, this is not restrictive. It is possible to use a movable pad 30, which is fitted removably or articulated on the mouth 12 of the base 10 or which is joined neither to the base 10 nor the lid 20. When the tub 1 is used, the pad 30 is simply removed in order to have access to its contents 5.

The function of the pad 30 is to seal the tub 1 when said tub is closed, in other words, when the lid 20 is closed on the base 10 (by screwing or by pressing down), whether under normal conditions of use (at atmospheric pressure (around 101,325 Pa, in other words, about 1 bar), as in a bathroom) or "extreme" conditions (during leak resistance tests in a vacuum bell jar, or in the baggage hold of an aircraft in flight).

For this, it comprises a shell 33 consisting of an upper part 32, adjacent to the lid, a lower part 34, adjacent to the base and assembled with a seal 40 on the upper part 32 in such a way as to form a closed sealed enclosure 35 containing a fluid 36. Here, the fluid 36 is ambient air, but it can be replaced by other fluids such as water, a gel, silicone, or a combination thereof, etc.

In addition, the seal 40 is also adapted to produce a seal between the environment outside the tub 1 and its contents 5 when the tub 1 is closed.

Finally, the constituent materials, the dimensions and the shape of the shell 33 and of the seal 40 and also the fluid 36 are chosen so as to obtain a deformable pad 30. Thus, during closure of the tub 1, the lid 20 and the base 10 come closer to one another and apply a force on the fluid 36 by deformation of the sealed enclosure 35, the fluid itself then applying a force on the seal 40 and compressing it against the mouth 12 of the base 10.

According to a preferred embodiment, under normal conditions of use, the fluid 36 within the enclosure 35 is at atmospheric pressure. In this way, during leak resistance tests in a vacuum bell jar, the difference in pressure between the fluid in the enclosure 35 and the surrounding environment (under the bell jar) reinforces the sealing produced by the pad 30. This is because the difference in pressure reduces the pressure of the fluid which increases the internal volume of the enclosure 35 which therefore applies an additional load on the base 10 via the seal 40, the tub 1 being held closed by the means (thread or hinge and push-button) for closing the lid 20 on the base 10.

The use of the fluid 36 in the enclosure 35 in combination with the seal 40 thus enables the leak resistance of the tub 1 under extreme conditions of use, in other words at low pressures (as in the baggage holds of aircraft in flight or during tests in a vacuum bell jar) to be noticeably increased, without, however, making the tub more difficult to handle under normal conditions of use at atmospheric pressure (in the bathroom etc.). In this way, the handling (opening/closing) of the tub 1 by a user is not changed; in particular, it is not made more difficult by increasing the effort required to open and close the tub 1 under normal conditions of use, but nevertheless enables the requirements of distributors of the tubs as regards leak resistance to be met. The difference in pressure in a vacuum bell jar in itself contributes the additional resistance to opening, to closing and to leaks made necessary by the low pressure of the surrounding environment.

We will now describe a first embodiment of the tub 1 with reference to FIGS. 1 to 4 (appended).

As can be seen in the drawings, the base 10 can, in particular, include the following elements: a lower casing 14, adjacent to the bottom of the base 10 and having a largely aesthetic role, in which is disposed a lining 16 adapted to accommodate a cup 18.

Here, the lower casing 14 has a squared polygonal cross-section. However, this is not restrictive, inasmuch as the lower casing 14 has a generally aesthetic role and a role as container for the other components of the base 10.

In the appended drawings, the lining 16 comprises a housing 16*a* arranged to receive the cup 18, having at its mouth a platform 16*b* of a shape generally complementary to the mouth of the lower casing 14 so that it can be inserted and held in position in the lower casing 14 by press fitting, by snap fitting and/or by adhesion. Here, the cup 18 and the housing 16*a* are cylindrical, so that there is a space 50 between the external cylindrical wall of the housing 16*a* and the polygonal internal wall of the lower casing 14. According to one embodiment, this space 50 can, in particular, be used to accommodate an applicator 55.

The cup 18 is intended to receive the cosmetic product 5, for example cream or a powder. It may also be covered with a protective cover that may have an aesthetic function and/or play a role as evidence of opening.

In the embodiment illustrated in FIGS. 1 to 4, the mouth 12 of the base 10 on which the seal 40 applies a load during closure of the tub 1 actually corresponds to the mouth of the cup 18. This mouth 12 includes, in particular, an internal wall 12*a*.

The lid 20 comprises an upper part 26, typically with a similar cross-section to that of the lower casing 14, and also a lower part 28 adapted to receive the pad 30. The upper part 26 of the lid 20 is here at a distance and is furthest away from the base 10 whereas the lower part 28 is adjacent to the pad 30, on the side of the base 10.

The lower part 28 of the lid 20 can, for example, be a plate inserted in the upper part 26 of the lid 20 by press fitting, by snap-fitting or by adhesion, and comprises positive connection means 28*a* with the pad 30.

Finally the pad 30 is here made in two parts 32, 34 assembled in a sealed manner with the seal 40.

As shown in FIG. 4*b*, the upper part 32 of the pad 30 consists of a rim 32*b* connected to a central hub 32*c* via spokes 32*d*, typically six spokes 32*d*. The rim 32*b*, the hub 32*c* and the spokes 32*d* are in addition fixed to a lower surface of a plate 32*a*, whose shape preferably corresponds to that of the internal wall 12*a* of the mouth 12 of the base 10, here the mouth of the cup 18, in order to improve the leak resistance of the tub 1.

The plate 32*a* also comprises an upper surface comprising positive connection means with the lower part 28 of the lid 20.

Here the pad 30 is thus of a generally circular shape, but it could also be polygonal or some other shape depending on the shape of the cup 18.

As shown in FIG. 4*a*, the lower part 34 of the pad 30 comprises a plate 34*a* of similar shape and dimensions to those of the upper plate 32, over one surface of which extends a rim 34*b* connected via spokes 34*d*, typically four spokes 34*d*, to a central shaft 34*c* complementary to the hub 32*c* of the upper part. Preferably, the rim 34*b* is disposed at a distance from the edge of the plate 34*a* in such a way as to leave a border 34*e* extending over the entire periphery of the plate 34*a*.

The border 34*e* is intended to receive the seal 40.

According to a preferred embodiment, the seal 40 is overmoulded directly on all or part of the width of the border 34*e*. Here, it is approximately L-shaped, the base of the L being overmoulded on the border 34*e* while the body of the L extends substantially perpendicular to the border 34*e*, so that it is adjacent to its edge. The lower part 34 can then further comprise a rib 34*f* running continuously or discontinuously along the length of the border 34*e*, on which the base of the L of the seal 40 is overmoulded, in order to improve its hold on the lower part 34 of the pad 30.

In a variant, the seal is fixed to the lower part 34 by glueing. It can also be injected or extruded then assembled directly onto an upper part (by laser, ultrasonic, or hot plate welding), or dual-injected with the upper part 32.

The pad 30 is then assembled, by fitting together the hub 32*c* and the shaft 34*c*, so that the plate 32*a* of the upper part 32 is in contact with the seal 40. Here, the plate 32*a* is actually in contact with the free part of the L-shaped body of the seal 40.

Advantageously, the upper 32 and lower 34 parts and the seal 40 are fixed together in a sealed manner, for example by laser, ultrasonic, or hot plate welding, so as to form the sealed enclosure 35.

It will thus be understood that in this embodiment, the sealed enclosure 35 has the form of an annular air chamber, which extends between the rim 32*b* and the seal 40.

Where the fluid 36 is ambient air, it is simply trapped between the two parts 32 and 34 of the pad 30 during assembly, and is therefore at atmospheric pressure. It is of course possible to insert a pressurised fluid 36 between the two plates 32 and 34, whether this involves a gas, a liquid, a gel or a combination thereof. Furthermore, the pad 30 is disposed against the lower part 28 of the lid 20 in such a way that the seal 40, which runs along the periphery of the shell 33, is arranged in order to apply a radial stress (in other words, from the inside of the tub towards the outside thereof) on the internal wall 12*a* of the mouth 12 of the cup 18. In the example shown in FIGS. 2 and 3, the pad 30 therefore projects relative to the lower part 28. However, when the lid 20 is sufficiently deep in relation to the mouth 12 to cover the outer walls of the mouth 12 and of the base 10 when the tub 1 is closed, the pad 30 can be disposed inside the lid 20 and not project beyond it.

It will of course be understood that the embodiment just described is not restrictive, and that the invention also covers pads 30 the hub of which extends from the plate of the lower part 34 and the shaft is disposed at the centre of the rim of the upper part 32, and/or the seal 40 is fixed to the upper part 32 of the pad 30 (and not to the lower part 34), and/or the seal 40 is fixed to the pad 30 after assembly of the upper part 32 and lower part 34, etc., these embodiments being perfectly equivalent.

Furthermore, in this embodiment, the sealing of the opening and the closing of the tub 1 is further improved by the presence of air inside the tub 1, particularly after it is first opened by the user. This is because, in "extreme" conditions of use, the air contained in the tub 1 (between the cosmetic product 5 and the pad 30), which is at atmospheric pressure, expands and consequently applies pressure on the lower part 34 of the pad 30. This pressure on the lower part 34 of the pad 30 therefore tends to increase the load applied on the seal 40 by the fluid 36 inside the sealed enclosure 35, and to further improve the contact between the seal 40 and the internal wall 12*a* of the mouth 12.

In order to improve the sealing of the tub 1, the internal wall 12*a* of the mouth 12 of the cup 18 can, in addition, be shaped as a shoulder 12*c*. Thus, during closure of the lid 20 on the base 10 of the tub 1, the seal 40 is pressed firmly against the internal wall 12*a* of the shoulder 12*c*. It deforms then becomes rounded at the point of contact with the shoulder 12*c*, so that a first part of the seal 40 rests against the horizontal base 12*c*' of the shoulder 12*c*, producing a first seal, while a second part of the seal 40 rests against the vertical part 12*c*" of the shoulder 12*c*, producing a second seal.

This embodiment also makes it possible to reduce the dimensional requirements of the seal 40. This is because sealing is ensured by the normal and radial forces applied to the seal 40 during its deformation against the shoulder 12*c* of the internal wall 12*a*, which ensure that the seal 40 is pressed firmly over its entire periphery against the vertical part of the shoulder 12*c*. The dimensional precision necessary is therefore less while at the same time ensuring contact over the entire periphery of the seal 40.

Conversely, in the case of a mouth 12 whose internal wall 12*a* is straight and does not have a shoulder, only a radial force is applied to the seal 40, so that the seal must have a greater dimensional regularity if this single contact is to ensure sealing. This dimensional accuracy is all the more important where the internal wall 12*a* is straight because the vertical part of the L of the seal 40 is straight. A variant embodiment therefore consists of using a seal 40 not with an L-shaped section, as shown in FIGS. 4*c* and 4*d* in particular, but with a U-shaped section (not shown), the base of the U being directed towards the internal wall 12*a* of the mouth 12, while the arms of the U extend substantially parallel to the lower part 34 of the pad 30. In this way, a more homogeneous contact is ensured between the U-shaped seal 40 and the internal wall 12*a* over the entire periphery of the mouth 12 despite errors in the dimensions and shape of the seal 40.

According to a second embodiment of the tub 1, shown in FIGS. 5 to 8 and 10 and 11 appended, the seal 40 extends from the lower face of the lower part 34 of the shell 33.

Here again, the base 10 of the tub 1 comprises a lower casing 14, a lining 16 and a cup 18, substantially identical to those of the first embodiment.

Furthermore, the mouth 12 of the base 10 over which the seal 40 also applies a load during closure of the tub 1 corresponds to the mouth of the cup 18, which includes, in particular, an upper edge 12*b*.

The lid 20 also comprises an upper part 26 similar to that of the lower casing 14, and also a lower part 28 adapted to receive the pad 30.

Finally, the pad 30 is made in two parts assembled in a sealed manner with the seal. Here, the shape and the dimensions of the pad 30 correspond substantially to those of the mouth 12 of the base 10, and more particularly those of the upper edge 12*b* of the mouth 12 of the cup 18. The pad 30 therefore once again has a generally circular shape, but could also be polygonal or another shape depending on the shape of the cup 18.

As shown in FIG. 8*a*, the upper part 32 of the pad 30 is formed by a plate 32*a*, an upper surface of which comprises positive connection means 28*a* with the lower part 28 of the lid 20, for example snap-fitting type means. The plate 32*a* can also comprise a plurality of spokes 32*d* extending radially from the positive connection means 28*a*, and having a stiffening role.

The lower part 34 of the pad 30 comprises a plate 34*a* whose shape and dimensions are similar to those of the upper plate 32*a*.

The lower part 34 also comprises a border 34*e* running along the periphery of the plate 34*a*, and separated therefrom by a traversing passage 34*f* intended to accommodate the seal 40. The seal 40 can, for example, be overmoulded in the passage 34*f* of the lower plate 34*a*, and extend at right angles to its lower surface. As a variant, the seal can also be dual-injected with the lower part 34. According to the embodiment shown in FIGS. 8*c* and 8*d*, the seal 40 is shaped as an omega channel 40*a* comprising a base 40*a*", which can be rounded overall as shown in FIGS. 7, 8, 10 and 11, and arms 40*a*', which extend from the base 40*a*" and end at their free extremity in two lugs. Here, the base 40*a* has a semicircular shape in the rest position (in other words, when the lid 20 is not closed on the tub 1). However, this is not restrictive. In addition, each lug of the channel is configured to be fixed to the border 34*e* or to the plate respectively, while its base 40*a*" extends towards the base 10 of the tub.

Optionally, the seal 40 shaped as an omega channel 40*a* can also comprise a resilient lip 40*b* extending radially towards the outside of the tub 1 from a radial extremity of the seal 40. The lip 40*b* is made so that it comes into lateral contact with the tub in order to provide diametral sealing of the tub (see FIGS. 10 and 11).

For this, the lip 40*b* can, for example, have an annular shape and extend over all or part of the circumference of the channel 40*a* from the lug of the external arm 40*a*' of the omega channel 40*a*, or from a zone in the vicinity thereof, towards the cup 18, and can be made in a single piece with the channel 40, or attached thereto. The lip 40*b* can also have a point of contraflexure, as can be seen for example in FIG. 11, so as to accentuate the load applied against the tub 1, and thus improve the seal therewith.

The internal wall 12*a* of the mouth 12 of the cup 18 can then have the shape of a shoulder 12*c* in order to further improve the leak resistance of the tub 1.

Thus, during closure of the lid 20 on the base 10 of the tub 1, the lip 40*b* of the seal 40 is pressed firmly against the internal wall 12*a* of the shoulder 12*c* and deforms under the effect of the pressure applied to it. In this way, in a manner similar to the first embodiment, a first part of the seal 40 (namely the base 40*a*" of the omega channel 40*a*) rests on the horizontal base 12*c*' of the shoulder 12*c*, producing a first seal, while a second part of the seal 40 (the lip 40*b*) rests radially on the vertical part 12*c*" of the shoulder 12*c* and produces a second seal.

The external edge of the plate 34*a* and/or the internal edge of the border 34*e*, which are adjacent to the seal 40, can then each comprise a shoulder 34*g*, extending continuously or discontinuously, on which the seal 40 is overmoulded, in order to improve its hold on the lower part 34 of the pad 30.

Optionally, the shoulder 34*g* can comprise channels 34*f* adapted to further improve the strength of the seal 40 on the lower part 34.

As a variant, the seal 40 can be glued to the lower part 34 or welded by laser or ultrasound.

According to a second variant (not shown in the drawings), the lower part 34, the border 34*e* and the seal 40 (with or without lip 40*b*) are integral and made in a single piece, for example by injection moulding of styrene-ethylene-butadiene-styrene (SEBS).

According to a third variant (not shown in the drawings) the seal 40 is overmoulded directly on the upper part 32 or dual-injected therewith, trapping the fluid. In this variant embodiment, the pad 30 does not therefore have a lower part.

The pad 30 is then assembled by fixing the plates 32*a* and 32*b* together in a sealed manner, for example by laser, ultrasonic or hot plate welding, in order to form the sealed enclosure 35 with the seal 40.

It will be understood that, in this embodiment, the sealed enclosure 35 has an annular shape the walls of which correspond to the seal 40 and to the part of the upper wall 32*a* adjacent to the seal 40.

Again, the fluid 36 is air trapped between the two parts 32 and 34 of the shell 33 during assembly, or a fluid (gas, liquid, gel or a combination thereof) inserted under pressure between the two plates.

In addition, the pad 30 is preferably disposed against the lower plate 28 of the lid 20 in such a way that the seal 40 applies a load to the upper edge 12*b* of the mouth 12 of the cup 18. The pad 30 can thus be disposed inside the lid 20, without projecting from it.

For this, the lower part 28 of the lid 20 can for example comprise a housing 29 adapted to receive the pad 30. In this way, the use of a pad 30 according to the invention does not increase the space occupied inside the tub 1. The volume of cosmetic product that can be contained in the tub 1 is thus greater.

In addition, as shown in FIG. 7, the upper edge can be plane and extend substantially parallel to the lower part 34 when the tub 1 is closed.

In this embodiment, the dimensional accuracy of the seal 40 must, however, be greater than in the embodiment shown in FIG. 3, inasmuch as the contact between the seal 40 and the mouth 12 is single (only a normal load being applied on the seal 40 by the upper edge 12*b* of the mouth 12). The seal 40 must therefore be sufficiently regular in its shape and dimensions to ensure that it rests substantially homogeneously on the entire periphery of the upper edge 12*b*.

In both embodiments described above, the upper 32 and lower 34 parts of the pad 30 can be made of a rigid polypropylene-type plastics material, whereas the seal 40 is made of a deformable resilient material, such as a vulcanised thermoplastic elastomer (TPV), thermoplastic urethane (TPU) with a Shore hardness of less than 85 Shore A, SEBS, silicone, etc.

In addition, the pressure applied by the seal 40 to the mouth 12—whether it involves the internal wall 12*a* (as is the case in the first embodiment, with reference to FIGS. 1 to 4) or the upper edge 12*b* (as is the case in the second embodiment, with reference to FIGS. 5 to 8)—can be made homogeneous by the use of a swivel joint R between the lower part 28 of the lid 20 and the pad 30 and/or between the upper part 32 and the lower part 34 of the pad 30. This swivel joint R makes it possible to compensate for dimensional disparities or those due to the manufacturing process.

For example, and as shown in the appended FIGS. 3*a* and 7*a*, the central hub 32*c* and the central shaft 34*c* can have an axial play (in a direction parallel to the axis of the hub 32*c* and the shaft 34*c*) and a radial play (transversely to the axis of the hub 32*c* and the shaft 34*c*) acting as a swivel joint and enabling the lower part 34 to translate and to pivot around the central hub 32*c* relative to the upper part.

In a variant, and as shown in the appended FIGS. 3*b* and 7*b*, the connection between the upper part 32 of the pad 30 and the positive connection means 28*a* can be a swivel joint, permitting pivoting movements of the upper part 32 in relation to the lower part 28 of the lid 20.

For a mouth 12 with a diameter of approximately 62 mm, the plates 32*a* and 32*b* can for example have a diameter of approximately 60 mm for a height when fitted together and provided with the seal 40 of about fifteen millimeters for the first embodiment and about six millimeters for the second embodiment.

The tub 1 can also comprise a housing 60 arranged to receive a product applicator 55. A housing 60 of this kind can be seen, for example, in FIGS. 5 to 7 and 9.

This housing 60 can, in particular, be arranged in the space 50 created between the internal face of the lower casing 14 and the external face of the lining 16.

The applicator 55 here takes the form of a spoon, with a handle 56 that can be flat or ergonomically shaped, at the extremity of which extends a plane or hollow part 57 arranged to take an amount of cosmetic product 5 in the cup 18. The spoon is, in addition, bent and has, for example, an angle of more than 90° between the hollow part 57 and the handle 56, typically of about 120°.

The housing 60 comprises a tongue 62, fitted in a resilient manner in the bottom 64 of the housing 60, so that in the rest position, the tongue 62 moves away from the bottom 64 of the housing 60.

As can be seen in FIG. 9, the bottom 64 is substantially parallel to a lateral wall of the lower casing 14.

In use, when a user recloses the tub 1, he/she inserts the applicator 55 in the housing 60, hollow part 57 downwards, until said hollow part reaches a stop position against the resilient tongue 62. The dimensions of the housing 60 and the applicator 55 are then such that the handle 56 of the applicator 55 projects outside the housing 60, thus protruding relative to the mouth 12 of the base 10. Then, when the lid 20 is closed on the base 10, the lid 20 (and where applicable the pad 30) then rests on the free extremity of the handle 57 and pushes the applicator 55 into the housing 60 by forcing the tongue 62 resiliently towards the bottom 64 thereof.

The insertion of the applicator 55 can be facilitated by using, an incurved surface 66 at the bottom of the housing 60 and adapted to the bent shape of the applicator 55. In addition, the upper face 68 of the housing can, for example, be complementary to the external face of the lining 16 and fixed thereto, for example by nesting, glueing, etc.

This embodiment is particularly suited to tubs provided with a lid 20 articulated on the base 10, and is not limited to the use of sealing means with a pad, but can be adapted to any tub with a space capable of receiving the housing 60.

The invention claimed is:

1. A container for a cosmetic product (5), comprising a base (10) defining a cup adapted to receive the cosmetic product (5);

a lid (20), arranged in order to be closed on the base (10); and a deformable pad (30) disposed between the base (10) and the lid (20); said pad (30) comprising a shell (33) and a seal (40) forming a closed sealed enclosure (35) and also a fluid (36) contained in the enclosure (35), and the pad (30) being arranged so as to apply a load to the base (10) via the seal (40) when the lid (20) is closed on the base (10), said shell (33) comprising an upper part (32) adjacent to the lid and a lower part (34) adjacent to the base, and the shell (33) comprises an upper part (32) and a lower part (34) joined to the upper part (32), the upper part (32) and the lower part (34) comprising a central hub (32*c*) and a complementary shaft (34*c*) adapted to cooperate with the central hub (32*c*) in order to join the lower part (34) to the upper part (32).

2. The container (1) according to claim 1, in which the fluid (36) is at a pressure equal to or greater than atmospheric pressure.

3. The container (1) according to claim 1, in which the seal (40) is made of a deformable resilient material selected from the group consisting of a thermoplastic elastomer, styrene-ethylene-butadiene-styrene (SEBS) and silicone.

4. The container (1) according to claim 1, in which the shell (33) comprises an upper part (32) and a lower part (34) joined to the upper part (32), and the seal (40) is overmoulded onto the upper (32) or lower (34) part of the shell (33) or is dual-injected therewith.

5. The container (1) according to claim 1, further comprising a swivel joint (R) between the lid (20) and the upper part (32) of the pad (30) or between the upper part (32) of the pad and the lower part (34) of the pad.

6. The container (1) according to claim 1, in which the base comprises a mouth (12) with an internal wall (12*a*), and the seal (40) is disposed at the periphery of the shell (33) and applies the load to the internal face of the mouth (12).

7. The container (1) according to claim 6, in which the internal wall (12*a*) of the mouth (12) is shaped as a shoulder (12*c*).

8. The container (1) according to claim 1, in which the base comprises a mouth (12) with an upper edge (12*b*), and the seal (40) is disposed on a lower face of the shell (33) and applies the load to the upper edge (12*b*) of the mouth (12).

9. The container (1) according to claim 8, in which the pad (30) comprises a lower part (34) consisting of a plate (34*a*) and a border (34*e*) running along the periphery of the plate (34*a*), and separated therefrom by a traversing passage (34*f*) intended to accommodate the seal (40).

10. The container (1) according to claim 9, in which the seal (40) is shaped as an omega channel (40*a*), the omega channel comprising arms (40*a*') that are fixed to the border (34*e*) and to the plate (34*a*) respectively, and a base (40*a*") that extends towards the upper edge (12*b*) of the mouth (12) forming a shoulder.

11. The container (1) according to claim 10, in which the seal (40) further comprises a resilient lip (40*b*) extending radially outwards from the seal (40), adapted so that it comes into lateral contact with the upper edge (12*b*) in such a way as to provide a diametral seal with the tub (1).

12. A container such as a tub for a cosmetic product (5), comprising a base (10);

a lid (20), arranged in order to be closed on the base (10); and a deformable pad (30) disposed between the base (10) and the lid (20);

said pad (30) comprising a shell (33) and a seal (40) forming a closed sealed enclosure (35) and also a fluid (36) contained in the enclosure (35), and the pad (30) being arranged so as to apply a load to the base (10) via the seal (40) when the lid (20) is closed on the base (10), wherein the shell (33) comprises an upper part (32) and a lower part (34) joined to the upper part (32), the upper part (32) and the lower part (34) comprising a central hub (32*c*) and a complementary shaft (34*c*) adapted to cooperate with the central hub (32*c*) in order to join the lower part (34) to the upper part (32).

13. The container (1) according to claim 12, in which the fluid (36) is at a pressure equal to or greater than atmospheric pressure.

14. The container (1) according to claim 12, in which the seal (40) is made of a deformable resilient material selected from the group consisting of a thermoplastic elastomer, styrene-ethylene-butadiene-styrene (SEBS) and silicone.

15. The container (1) according to claim 12, in which the shell (33) comprises an upper part (32) and a lower part (34) joined to the upper part (32), and the seal (40) is overmoulded onto the upper (32) or lower (34) part of the shell (33) or is dual-injected therewith.

16. The container (1) according to claim 12, further comprising a swivel joint (R) between the lid (20) and the upper part (32) of the pad (30) or between the upper part (32) of the pad and the lower part (34) of the pad.

17. The container (1) according to claim 12, in which the base comprises a mouth (12) with an internal wall (12*a*), and the seal (40) is disposed at the periphery of the shell (33) and applies the load to the internal face of the mouth (12).

18. The container (1) according to claim 17, in which the internal wall (12*a*) of the mouth (12) is shaped as a shoulder (12*c*).

19. The container (1) according to claim 12, in which the base comprises a mouth (12) with an upper edge (12*b*), and the seal (40) is disposed on a lower face of the shell (33) and applies the load to the upper edge (12*b*) of the mouth (12).

20. The container (1) according to claim 19, in which the pad (30) comprises a lower part (34) consisting of a plate (34*a*) and a border (34*e*) running along the periphery of the plate (34*a*), and separated therefrom by a traversing passage (34*f*) intended to accommodate the seal (40).

21. The container (1) according to claim 20, in which the seal (40) is shaped as an omega channel (40*a*), the omega channel comprising arms (40*a*') that are fixed to the border (34*e*) and to the plate (34*a*) respectively, and a base (40*a*") that extends towards the upper edge (12*b*) of the mouth (12) forming a shoulder.

22. The container (1) according to claim 21, in which the seal (40) further comprises a resilient lip (40*b*) extending radially outwards from the seal (40), adapted so that it comes into lateral contact with the upper edge (12*b*) in such a way as to provide a diametral seal with the tub (1).

* * * * *